United States Patent [19]

Clendening, Jr. et al.

[11] 4,107,828

[45] Aug. 22, 1978

[54] YARN TREATING JET

[75] Inventors: Francis Joseph Clendening, Jr.; Elva Lincoln Rose, both of Wilmington, Del.

[73] Assignee: E. I. Du Pont de Nemours and Company, Wilmington, Del.

[21] Appl. No.: 793,850

[22] Filed: May 4, 1977

[51] Int. Cl.[2] ..... D02G 1/16

[52] U.S. Cl. ..... 28/254; 28/273

[58] Field of Search ..... 28/271, 272, 273, 274, 28/254, 255, 256

[56] References Cited

U.S. PATENT DOCUMENTS

| | | | |
|---|---|---|---|
| 3,005,251 | 10/1961 | Hallden et al. | 28/273 X |
| 3,633,808 | 1/1972 | Svaty | 28/273 X |
| 3,881,231 | 5/1975 | Price et al. | 28/254 |
| 3,892,020 | 7/1975 | Koslowski | 28/273 X |

FOREIGN PATENT DOCUMENTS

| | | | |
|---|---|---|---|
| 467,228 | 2/1971 | Japan | 28/273 |

*Primary Examiner*—Louis K. Rimrodt

[57] ABSTRACT

A jet device for fluid texturing yarn has a yarn needle mounted in the jet body through which yarn passes to the outlet end of the jet. Pressurized air enters a chamber surrounding the needle through a stream forming restriction which is angled to direct a stream of air across the yarn guiding element and toward the outlet end of the jet providing greater turbulence for texturing the yarn.

6 Claims, 6 Drawing Figures

YARN TREATING JET

BACKGROUND OF THE INVENTION

This invention relates to air texturing of yarn and, more particularly, to improvements in a fluid jet apparatus used to texture the yarn.

Fluid jet apparatus for texturing yarn usually comprises a conically-tipped yarn guiding tube or needle for introducing yarn into the apparatus, and inlet for supplying pressurized fluid to a chamber surrounding the forward end of the yarn guiding element and a nozzle having a conical entrance through which yarn and fluid leave the jet.

SUMMARY OF THE INVENTION

It has now been found that improved texturing performance can be obtained for such jet apparatus by incorporating a restriction in the inlet passage for supplying pressurized fluid to the chamber surrounding the forward end of the yarn needle and angling the axis of the restriction across the axis of the yarn guiding element to intersect the conical entrance of the nozzle at an angle of from about 65° to about 110°.

The yarn texturing jet includes a body having yarn inlet and outlet ends connected by a central bore, means for introducing pressurized gas through a gas inlet into the bore between its ends, a nozzle block having a conical entrance located in the bore at the outlet end, and a conically-tipped yarn guiding element extending into the bore from the yarn inlet end of the body. The nozzle block, the yarn guiding element and the bore in the body form an annular chamber in the body. The yarn guiding element has a passage therethrough for guiding yarn from the yarn inlet of the body past the gas inlet through the exit end of the yarn guiding element to the nozzle block. The improvement comprises a stream forming restriction joining the gas inlet to the chamber. The restriction has a central axis directed across the central axis of the yarn guiding element to intersect the conical surface entrance of the nozzle block at an angle of from about 65° to about 110° and at a location shielded from the restriction by the yarn guiding element.

The restriction may be a cylindrical passage, or a venturi which has a flared inlet and a gradually expanding flared outlet connected by a constriction.

DETAILED DESCRIPTION OF THE DRAWING

Figure 1:
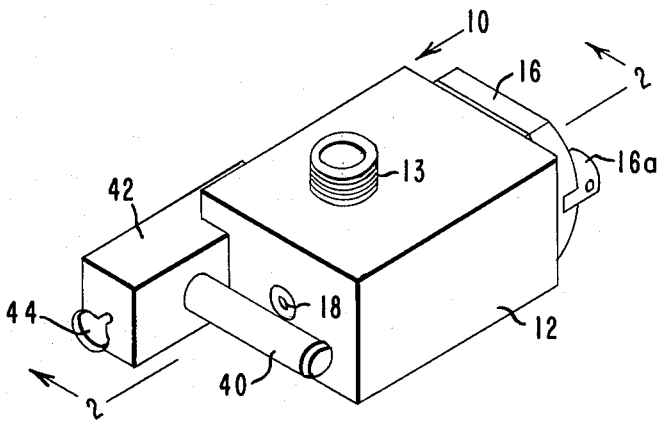
FIG. 1 is a perspective view of a jet incorporating the preferred embodiment of the invention with a baffle fixed with relation to the outlet end of the jet.
Figure 2:
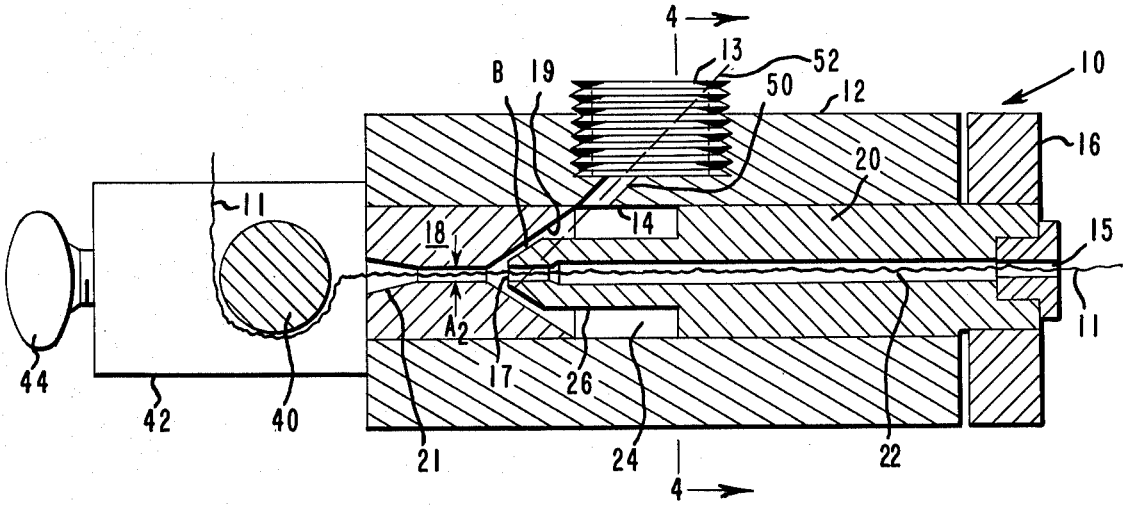
FIG. 2 is an enlarged section of FIG. 1 taken along the line 2—2.
Figure 4:
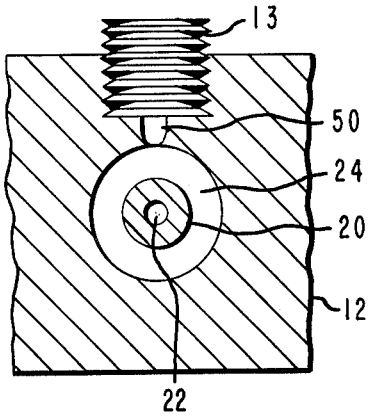
FIG. 4 is a partial section of FIG. 2 taken along the line 4—4.

Referring now to the preferred embodiment illustrated in FIGS. 2 and 4, the jet 10 includes as components, a body member 12 having a central bore 14, a gas inlet 13 leading in the body 12 intermediate its ends, a flange 16 located outside the body 12 at the yarn inlet end of the body, a nozzle block 18 located in the bore 14 at the outlet end of the body, and a yarn guiding element (commonly referred to as a yarn needle in the trade) 20 fixed to the flange 16 and having a passage 22 therethrough for guiding yarn 11 from the yarn inlet 15 of the jet past the gas inlet 13 through the exit end 17 of the yarn guiding element to the nozzle block 18. The flange 16 is adapted to freely receive bolt **16*a*. Bolt 16*a* threads into body 12 and abuts against a portion of flange 16 to serve as a stop for the movement of yarn needle 20 out of bore 14, i.e., serves as a means for limiting movement of the flange 16 away from the inlet end of the body 12. The outer diameter of the yarn needle 20 which approximates the inside diameter of bore 14 is reduced in the region opposite the gas inlet 13. This reduced portion 26 of the needle in conjunction with bore 14 forms an annular chamber 24. The forward reduced portion 26 of the yarn needle 20 tapers at an included angle of preferably about 60° to the exit end 17 and nozzle block 18 has a converging conical entrance 19 with an included angle of preferably about 60° and a minimum throat area $A_2$. Entrance 19 leads to exit passage 21 which may be a constant diameter cylindrical bore or preferably may have a short cylindrical portion followed by a conical portion which diverges toward the outlet end of the jet at an included angle of about 7° to form a venturi. The tapering surface on the end of element 20 and the conical entrance 19** of the venturi form an annular restriction between them designated B.

Compressed air or other fluid is supplied to inlet 13 which is joined to chamber 24 by a stream forming restriction 50 which is in the preferred embodiment a restricted cylindrical passage 0.078 inch in diameter. The central axis 52 of the restriction is directed across the central axis of the yarn guiding element 20 to intersect the conical surface 19 of the nozzle block 18 at an angle $\alpha$ of from about 65° to about 110° and at a location which is shielded from the restriction 50 by the reduced portion 26 of yarn guiding element 20. The restriction 50 is shown located very close to the conical entrance 19 of the venturi. A major portion of the stream of gas issuing from restriction 50 impinges on the outer surface of reduced portion 26 of yarn needle 20, divides around the yarn needle and recombines on the far side with increased turbulence and impacts against conical surface 19. Another smaller portion of the stream of gas issuing from restriction 50 passes directly through annulus B to impinge directly on the yarn after it leaves the exit end 17 of the yarn guiding element. The major portion of the stream after impacting against surface 19 is now highly turbulent and passes through annulus B to impinge directly on yarn 11. Other portions of the stream after impacting against surface 19 are deflected within chamber 24 to create turbulence which passes through annulus B at other locations around the annulus.

A cylindrical baffle 40 is slideably mounted in bracket 42 at the outlet end of the jet. Thumb screw 44 holds baffle 40 in position in bracket 42 and when released the baffle can be slid from in front of the exit of the jet 10 to facilitate stringup, etc.

To stringup the jet, yarn 11 is presented to the inlet end 15 of the jet 10. Compressed air is supplied to inlet 13, then to bore 14 through restriction 50. The flange 16 is moved inwardly away from the head of bolt 16*a*, i.e., from a preset operating position to a stringup position so that an aspirating effect draws the yarn 11 through the inlet 15 and out through passage 22. When the yarn emerges from the venturi 18, the flange 16 is allowed to return to its preset operating position against bolt 40 under the force of air pressure against yarn needle 20 in the reduced region of the yarn needle opposite inlet 13.

This texturing jet with stream forming restriction 50 joining gas inlet 13 to the bore 14 jet and angled to direct a stream of air across the end of the yarn needle creates turbulence in chamber 24 ahead of annulus B which is amplified in passing through annulus B resulting in greater turbulence to act on the yarn in the space between the exit end of the yarn needle and the entrance of the nozzle thus increasing the efficiency of the jet without sacrificing texturing quality.

Figure 3:
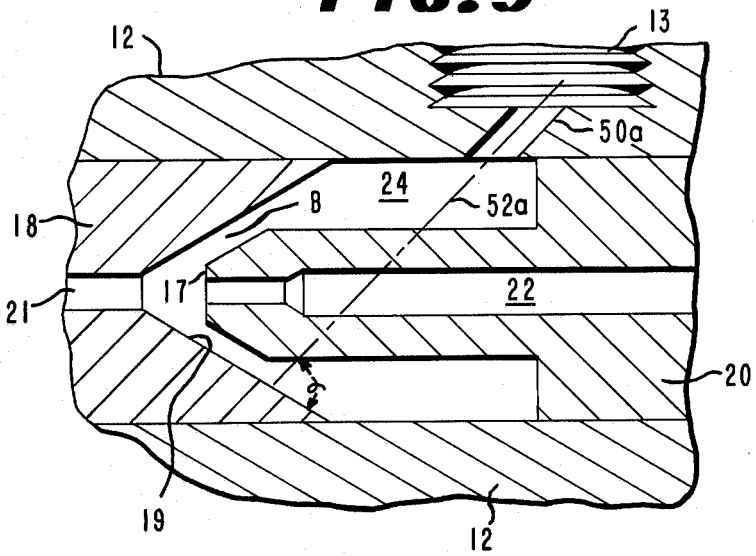
FIG. 3 is an enlarged fragmentary section illustrating an alternate location for the restriction joining the gas inlet to the bore of the jet body.

An alternate location for restriction is shown in FIG. 3 in which restriction 50*a* is located upstream from the venturi so that the stream from the restriction enters the chamber 24 along central axis 52*a* and is directed across the central axis of the yarn guiding element 20 to intersect the conical surface 19 at an angle $\alpha$ which again is from about 65° to about 110°. The operation is about the same as described above except that with this arrangement there is no opportunity for a portion of the stream issuing from restriction 50*a* to pass directly through annulus B as is the case where a portion of the restriction 50 (FIG. 2) is in line with a portion of annulus B. In any embodiment of the invention, the angle between central axis 52 or 52*a* of restriction 50 or 50*a* and the central axis of yarn guiding element 20 may be varied, consistent with the other limitations described above.

Figure 5:
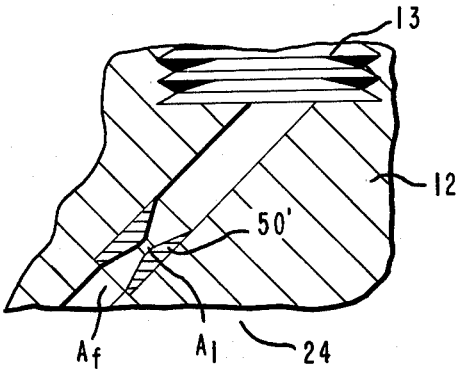
FIG. 5 is an enlarged fragmentary section illustrating another configuration for the restriction joining the gas inlet to the bore of the body.

As shown in FIG. 5 the restriction 50' may be embodied in an insert for greater ease and accuracy of fabrication and it may be constructed as a converging/diverging venturi to give supersonic flow at its outlet. In this case, $A_f$ will designate the outlet area and $A_l$ the reduced area. The preferred ratio $A_l$ to $A_f$ is about 0.67. In addition, $A_l$ will be less than throat area $A_2$ (FIG. 2).

Figure 6:
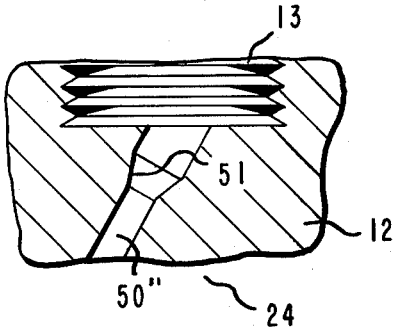
FIG. 6 is similar to FIG. 5 illustrating still another configuration for the restriction in the gas inlet to the body.

In FIG. 6, the restriction 50'' is constructed as a cylindrical orifice with a conical entrance 51.

What is claimed is:

1. In a yarn texturing jet including a body having yarn inlet and outlet ends connected by a central bore, means for introducing pressurized gas through a gas inlet into said bore between said ends, a nozzle block having a conical surface entrance located in said bore at said outlet end, and a yarn guiding element extending into said bore from the yarn inlet end of the body, said element having a passage therethrough for guiding yarn from the yarn inlet of the body past the gas inlet through the exit end of said element to the conical entrance of the nozzle block, said nozzle block, said guiding element and the bore in said body forming an annular chamber in said body, the improvement for creating turbulence in said annular chamber comprising: a restriction joining said gas inlet and said chamber, said restriction having a central axis directed across the central axis of the yarn guiding element to intersect the conical surface entrance of the nozzle block at a location shielded from the restriction by the yarn guiding element whereby pressurized gas issuing from said restriction impinges on the surface of the yarn guiding element to create turbulence in said annular chamber.

2. The jet as defined in claim 1, said restriction being a cylindrical passage joining the gas inlet and said bore.

3. The jet as defined in claim 2, there being a tapered passage joining the gas inlet and said cylindrical passage.

4. The jet as defined in claim 1, said restriction being a venturi joining the gas inlet and said bore.

5. The apparatus of claim 1, said conical surface entrance having an included angle of about 60°, said central axis of said restriction intersecting said conical surface entrance at an angle of from about 65° to about 110°.

6. The apparatus of claim 5, the central axis on said restriction intersecting said conical surface entrance at an angle of about 90°.

* * * * *